United States Patent [19]

Raasch et al.

[11] Patent Number: 4,744,210

[45] Date of Patent: May 17, 1988

[54] METHOD AND DEVICE FOR PRODUCING A TWISTED THREAD FROM SPINNING FIBERS

[75] Inventors: Hans Raasch; Theo Lembeck, both of Mönchengladbach, Fed. Rep. of Germany

[73] Assignee: W. Schlafhorst & Co., Mönchengladbach, Fed. Rep. of Germany

[21] Appl. No.: 755,271

[22] Filed: Jul. 15, 1985

[30] Foreign Application Priority Data

Jul. 14, 1984 [DE] Fed. Rep. of Germany ..... 3425980

[51] Int. Cl.[4] ..... D01H 7/898; D01H 1/135

[52] U.S. Cl. ..... 57/401; 57/408; 57/411

[58] Field of Search ..... 57/400, 401, 408, 411, 57/263

[56] References Cited

U.S. PATENT DOCUMENTS

| | | | |
|---|---|---|---|
| 4,315,398 | 2/1982 | Parker et al. | 57/401 |
| 4,522,023 | 6/1985 | Stahlecker | 57/401 |
| 4,537,021 | 8/1985 | Parker | 57/401 |
| 4,570,434 | 2/1986 | Stahlecker | 57/401 |
| 4,571,932 | 2/1986 | Stahlecker et al. | 57/408 X |
| 4,606,187 | 8/1986 | Stahlecker | 57/401 |

*Primary Examiner*—John Petrakes

*Attorney, Agent, or Firm*—Herbert L. Lerner; Laurence A. Greenberg

[57] ABSTRACT

A method of producing a twisted thread from spinning fibers by friction spinning includes moving two friction elements of a friction spinning machine in opposite directions defining a spinning wedge therebetween, at least one of the friction elements having a perforated wall, feeding spinning fibers into the spinning wedge in a given direction with a transporting air current, continuously withdrawing a twisted thread from the spinning wedge in the given direction, sucking a first part of the transporting air current through the perforated wall of at least one of the friction elements, and sucking a second part of the transporting air parallel to the spinning wedge, parallel to the thread and opposite to the given direction in which the thread is withdrawn and the fibers are fed into the spinning wedge, and a device for carrying out the method.

17 Claims, 2 Drawing Sheets

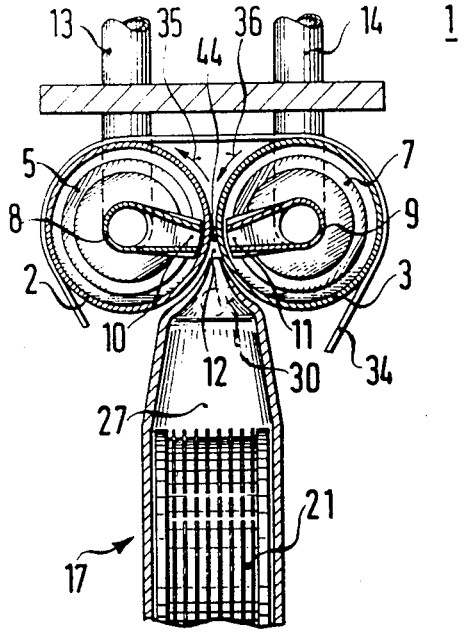
FIG. 2
FIG. 3
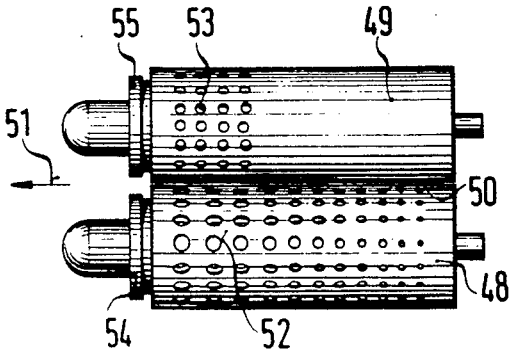

METHOD AND DEVICE FOR PRODUCING A TWISTED THREAD FROM SPINNING FIBERS

The invention relates to a method and a device for producing a twisted thread from spinning fibers by friction spinning, wherein a spinning wedge is formed by moving two friction elements of a friction spinning machine in opposite directions, the spinning fibers are fed into the spinning wedge in the direction in which the thread is withdrawn by a transporting air stream, and the twisted thread or yarn is continuously withdrawn from the spinning wedge and collected on a spool or the like.

Since the withdrawal velocity of the thread which is being formed in the spinning wedge is considerably less than the velocity of the spinning fibers as they enter into the spinning wedge, the fibers become compressed as they touch the friction elements or the thread end. Therefore, they lose their elongated form if they were previously elongated.

Due to the random position of the fibers as they are tied into the thread, the quality of the thread is reduced and especially, the strength of the thread is decreased.

It is accordingly an object of the invention to provide a method and device for producing a twisted thread from spinning fibers, which overcomes the hereinaforementioned disadvantages of the heretofore-known methods and devices of this general type, and to produce a twisted thread with good quality and great strength by friction spinning.

With the foregoing and other objects in view there is provided, in accordance with the invention, a method of producing a twisted thread from spinning fibers by friction spinning, which comprises moving two friction elements of a friction spinning machine or unit in opposite directions defining a spinning wedge therebetween, at least one of the friction elements having a perforated wall, feeding spinning fibers into the spinning wedge in a given direction with a transporting air current, continuously withdrawing a twisted thread from the spinning wedge in the given direction and onto a collecting spool or the like, sucking a first part of the transporting air current through the perforated wall of at least one of the friction elements, and sucking a second part of the transporting air parallel to the spinning wedge, parallel to the longitudinal axis of the thread and opposite the given direction in which the thread is withdrawn and the fibers are fed into the spinning wedge.

The advantageous result of these provisions is that the fibers keep their elongated position, and are tied into the thread being formed in good order and not in an irregular fashion.

In accordance with another mode of the invention, there is provided a method which comprises adjusting the first and second parts of the transporting air current relative to each other for: sucking the spinning fibers into the spinning wedge with the first part of the transporting air current and laying the spinning fibers onto the wall of at least one of the friction elements or into the thread being formed; and for delaying the spinning fibers with the second part of the transporting air current for holding back ends of the spinning fibers farthest upstream as seen in the given direction in which the thread is withdrawn, elongating and aligning the spinning fibers substantially parallel to each other in the spinning wedge and laying the spinning fibers onto the wall of at least one of the friction elements or into the thread being formed.

The adjustment of the suction air stream can be made gradually. It is possible to initially set the first suction air current and observe the spinning result, and then the suction air current can be set and the spinning result can be observed again. Finally, corrective adjustments are made, while always observing the spinning result. Once the spinning result corresponds to the requirements, the quantities of the suction air streams are not changed again. In the next batch, it is possible to start out from the existing setting of the suction air currents.

During the adjustment of the suction air currents, it is not necessary to observe the fibers themselves. The quality of the spun thread, especially its appearance and its tensile strength, permit conclusions to be made, if the fibers enter into the spinning wedge as parallel as possible and in an elongated position, as desired.

In accordance with a further mode of the invention, there is provided a method which comprises removing the spinning fibers from the outer surface of a loosening roller with the transporting air current in the form of an air blast. The air quantity required to reliably remove the fibers from the surface of the loosening roller is smaller with an air blast than with a suction air current. The air current from the blower can be conducted tangentially past the loosening roller.

In accordance with an added mode of the invention, there is provided a method which comprises accelerating the transporting air current toward the spinning wedge by gradually or progressively narrowing a flow channel carrying the transporting air current. This provides an improved elongating of the flowing fibers.

In accordance with an additional mode of the invention, there is provided a method which comprises subjecting the thread forming in the spinning wedge to friction forces increasing in the given direction in which the thread is withdrawn. This provision also prevents a twist which is too strong from being given to the core of the thread, which could lead to excessive twisting of the core and thereby to a reduction of the tensile strength of the spun thread.

However, if the friction forces are increased along the thread-forming zone, the rear of the thread end which later forms the thread core, is initially only twisted slightly. Then, as the thread is pulled out, it participates to the increasing friction to which the mantle or outer fibers are exposed.

In order to carry out the method, there is provided a friction spinning device for producing a twisted thread from spinning fibers, comprising two friction elements moving in opposite directions and defining a spinning wedge therebetween, at least one of the friction elements having a perforated wall, a first suction device disposed behind the perforated wall, the first suction device having a suction port formed therein directed against the spinning wedge, a fiber feeding device for feeding fibers to the spinning wedge, a thread withdrawal device for withdrawing a thread from the spinning wedge in a given direction, and a second suction device having a suction port formed therein at an end of the spinning wedge disposed upstream as seen in the given thread withdrawal direction.

In accordance with another feature of the invention, there are provided means for regulating the second suction device. During the spinning process, the second suction device is always in operation. It represents an essential element of the friction spinning device for the spinning operation.

In accordance with a further feature of the invention, the fiber feeding device includes means for transporting air and spinning fibers, the transporting means having a fiber channel ending in the spinning wedge, and including an air blast generator connected to the transporting means. This is done for reducing the required quantities of transporting air. Thus, the fibers are blown into the fiber channel and sucked out from the spinning wedge by the two suction devices. Reducing the amount of transporting air has the advantageous result of enabling the air blower and the suction devices to be made smaller.

An increasing reduction of the cross section of the fiber channel causes an elongation of the fibers in the fiber channel.

In accordance with an added feature of the invention, the spinning wedge includes a front and a rear and the first suction device includes means for increasing the suction force or amount of suction along the spinning wedge from the rear toward the front. This is done in order to expose the forming thread in the spinning wedge to increasing friction forces in the direction in which the thread is withdrawn.

In accordance with an additional feature of the invention, the suction force or suction amount increasing means are in the form of a widening of the suction port of the first suction device from the back toward the front thereof.

According to the invention, it is also possible to provide an increase of the friction forces directly, instead of increasing the friction forces indirectly. In accordance with again another feature of the invention, the spinning wedge includes a front and a rear, and including means for strenghtening friction forces acting on the thread being formed along the spinning wedge from the rear toward the front.

In accordance with again a further feature of the invention, the friction force strengthening means are in the form of an increase in the number and/or size of the perforations in at least one of the friction elements from the rear toward the front of the spinning wedge.

In an alternate version, or additionally, in accordance with again an added feature of the invention, the friction force strengthening means are in the form of a placement of perforations wherein one of the friction elements has perforations only at the front of the spinning wedge and the other of the friction elements has perforations throughout.

In accordance with a concomitant feature of the invention, the friction force strengthening means are in the form of an increase of the friction value or coefficient of the surface of at least one of the friction elements from the rear toward the front of the spinning wedge.

For instance, the friction element can have a rubber-like surface with a Shore-hardness that decreases from the rear toward the front. The explanations given above clearly show that the friction spinning device can include two friction elements which move in opposite directions, but only one of which must have perforations. However, as a rule, both friction elements are made with perforations, and in some embodiments of the invention, this is even absolutely necessary. Normally, the friction elements are constructed in the form of drums. However, it is also possible to work with a band-shaped friction element in conjunction with a drum-shaped friction element. Instead of drum-shaped friction elements, conical friction elements can also be used. A combination of a drum-shaped or conical friction element together with a disc-shaped friction element can also be used. In any case, in the spinning wedge the friction elements move in opposite senses.

Other features which are considered as characteristic for the invention are set forth in the appended claims.

Although the invention is illustrated and described herein as embodied in a method and device for producing a twisted thread from spinning fibers, it is nevertheless not intended to be limited to the detals shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 2 is a fragmentary, cross-sectional view of the friction spinning device taken along the line II—II in FIG. 1, in the direction of the arrows; and FIG. 3 is an elevational view of a specially constructed friction element pair.

Figure 1:
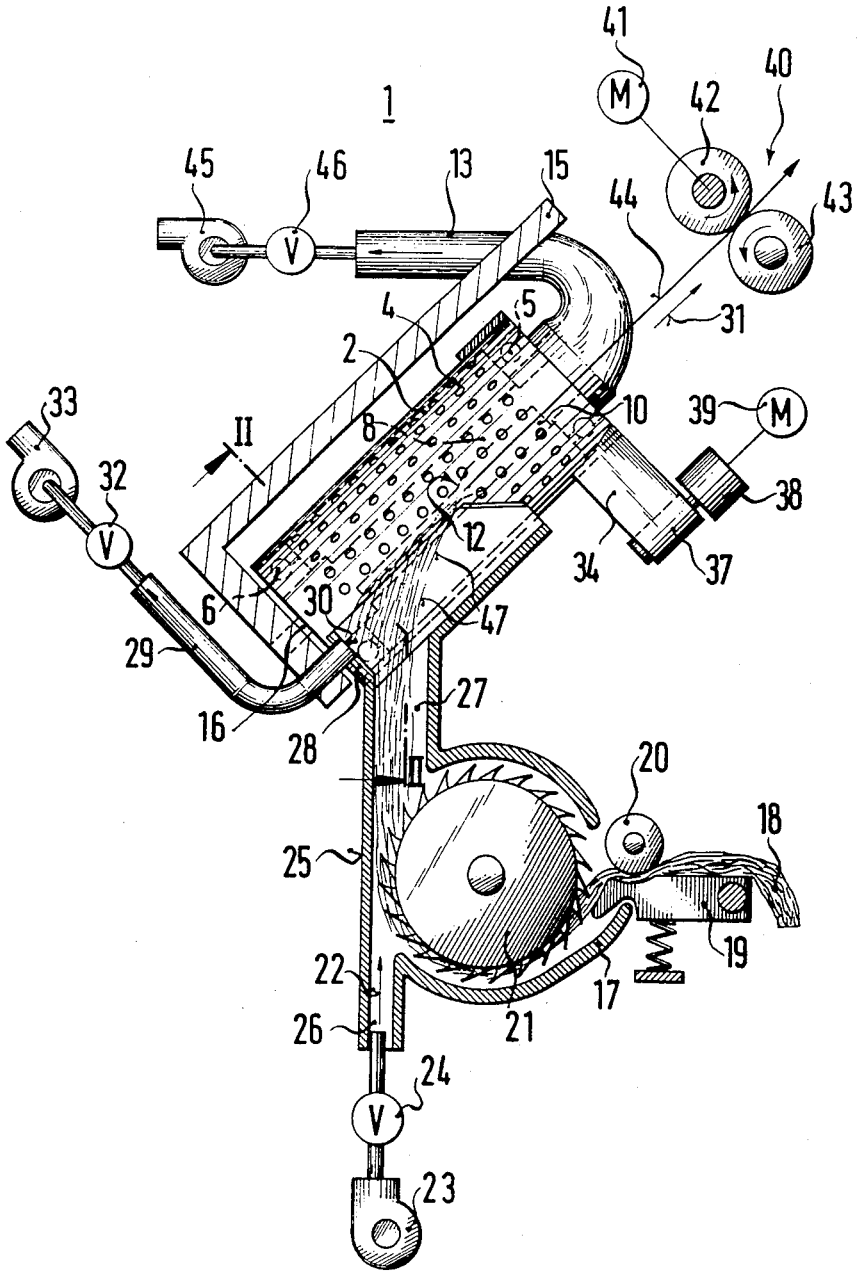
FIG. 1 is a diagrammatic, longitudinal-sectional view of a friction spinning device according to the invention.

Referring now to the figures of the drawings in detail and first, particularly, to the embodiment of FIGS. 1 and 2 thereof, there is seen a friction spinning device which is designated as a whole with reference numeral 1 and which includes two friction elements 2 and 3 of perforated drums that can move in opposite directions. The perforations are holes 4 disposed in the shells of the drums. The sieve-like perforated drums 2, 3 are supported on ball bearings, so that they can rotate in the same senses. For instance, the friction element 2 has bearings 5 and 6, according to FIG. 1. In FIG. 2, only the front bearing 7 of the friction element 3 is visible.

The friction element 2 has a suction device 8 and the friction element 3 has a suction device 9, in the interiors thereof. The suction device 8 has a suction port 10, which is directed toward a spinning wedge 12 and the suction device 9 has a suction port 11 which is directed toward the spinning wedge 12. The suction ports 10 and 11 extend along the length of the spinning wedge 12. However, the ports do not have a constant width all along, but rather they become wider from the rear toward the front, which is from the lower left toward the upper right as shown in FIG. 1. The suction device 8 is attached to a tube 13, while the suction device 9 is attached to a tube 14. The two tubes 13 and 14 serve for the conduction of the suction air and at the same time serve as carrier tubes for the friction elements. For this purpose, the tubes 13 and 14 are securely anchored in a machine frame 15. The tube 13 carries the front bearing 5 and the tube 14 carries the front bearing 7. According to FIG. 1, the rear bearings 6 are supported on axle journals 16, which are also securely anchored at the machine frame 15.

The friction spinning device 1 is provided with a fiber-feeding device 17. In the fiber-feeding device 17, sliver 18 passes through a feeding or lap plate 19 which is resiliently supported and through a feed roller 20 to a rotating loosening roller 21. The loosening roller 21 is provided with needles or teeth around the periphery thereof and is therefore capable of combing-out individual fibers and of exposing them to a transporting air current or stream 22, which originates from an air blower 23. The air is supplied to the fiber-feeding device 17 through a valve 24 of an air and fiber transporting device 25. The transport air device 25 has a transport air inlet channel 26, and a fiber channel 27 which terminates in the spinning wedge. The drawings show, that the fiber channel 27 narrows toward the spinning wedge 12, but at the same time elongates to form a slot.

The back end 28 of the fiber channel 27, which extends up to the spinning wedge 12, carries an additional suction device 29, with a suction port 30 that is disposed at the end of the spinning wedge 12 which is upstream as viewed in the direction 31 in which the thread is pulled and in which the fibers are fed in. The tubular additional suction device 29 is connected through a control valve 32 to a suction air source 33.

According to FIG. 1, both friction elements 2 and 3 are driven by a drive belt 34, which is wrapped around both friction elements in such a way that the rotational direction of the friction elements is as indicated by the directional arrows 35 and 36 in FIG. 2. The drive belt runs over a pulley 37, which is part of a transmission 38. A motor 39 sets the transmission 38 and therefore the pulley 37, in motion.

The friction spinning device also includes a thread withdrawal device 40. This thread withdrawal device 40 is formed of a roller 42 which is driven by a motor 41, and a counter-roller 43 which can be pressed against the roller 42 and against a thread 44 to be transported.

A common suction generator 45 connected to the two tubes 13 and 14 through a valve 46, is provided for supplying the two suction devices 8 and 9 with suction air and sucking a first part of the transporting air current 22 through the perforated walls of the friction elements 2, 3. In an alternate version, a valve can also be provided for each tube.

During the spinning operation, fibers 47 pass the suction orifice 30 of the additional suction device 29 and enter into the spinning wedge 12. The suction orifice 30 causes a backwardly-directed suction which, however, is not strong enough to suck in any of the fibers but sucks a second part of the transporting air current 22 parallel to the spinning wedge 12, parallel to the thread 44 and opposite to the direction 31 in which the thread 44 is withdrawing and the fibers 47 are fed into the spinning wedge 12. The fibers are only elongated and bind themselves into the thread 44 being formed, with their forward ends. This takes place in the rear half of the spinning wedge 12. In the forward half of the spinning wedge 12, the thread 44 being formed is exposed to stronger friction, because the effect of the two suction devices 8 and 9 is greater there. This is caused by the widening of the suction openings 10, 11, respectively, as shown in FIG. 1.

In the alternate construction according to FIG. 3, friction elements 48 and 49 are provided which have special features along the length of the spinning wedge 50 from the rear toward the front in the thread withdrawal direction 51, for increasing the strength of the friction forces, which act on the non-illustrated thread being formed. In the case of the friction element 48, this feature provides that the size of the perforations 52 increases from the rear toward the front. Therefore, at the front more air is sucked in than at the rear. In contrast, in the case of the friction element 49, the feature provides that perforations 53 are provided only in the front while in the middle and in the rear part, there are none.

With respect to FIG. 3, it should also be noted that each friction element 48, 49 is driven by a separate drive belt 54, 55, respectively. This has the advantage of not causing the thread to run through a loop of a belt.

The invention is not limited to the illustrated and described embodiments which were used as an example.

We claim:

1. Method of producing a twisted thread from spinning fibers by friction spinning, which comprises moving two friction elements of a friction spinning machine in opposite directions defining a spinning wedge therebetween, at least of the friction elements having a perforated, wall, feeding spinning fibers into the spinning wedge in a given direction with a transporting air current, continuously withdrawing a twisted thead from the spinning wedge in said given direction, sucking a first part of the transporting air current through the perforated wall of at least one of the friction elements, sucking a second part of the transporting air parallel to the spinning wedge, parallel to the thread and opposite to the given direction in which the thread is withdrawn and the fibers are fed into the spinning wedge, and amplifying the sucking of the first part of the transporting air current in the given direction in which the twisted thread is withdrawn.

2. Method according to claim 1, which comprises adjusting the first and second parts of the transporting air current relative to each other for: sucking the spinning fibers into the spinning wedge with the first part of the transporting air current and laying the spinning fibers onto the wall of at least one of the friction elements and into the thread being formed; and for delaying the spinning fibers with the second part of the transporting air current for holding back ends of the spinning fibers farthest upstream as seen in the given direction in which the thread is withdrawn, elongating and aligning the spinning fibers substantially parallel to each other in the spinning wedge and laying the spinning fibers onto the wall of at least one of the friction elements and into the thread being formed.

3. Method according to claim 1, which comprises removing the spinning fibers from the outer surface of a loosening roller with the transporting air current in the form of an air blast.

4. Method according to claim 1, which comprises accelerating the transporting air current toward the spinning wedge by progressively narrowing a flow channel carrying the transporting air current.

5. Method according to claim 1, which comprises subjecting the thread forming in the spinning wedge to friction forces increasing in the given direction in which the thread is withdrawn.

6. Friction spinning device for producing a twisted thread from spinning fibers, comprising two friction elements moving in opposite directions and defining a spinning wedge therebetween having a front and a rear, at least one of said friction elements having a perforated wall, a first suction device disposed behind said perforated wall, said first suction device having a suction port formed therein directed against said spinning wedge, a fiber feeding device for feeding fibers to said spinning wedge in a given direction, a thread withdrawal device for withdrawing a thread from said spinning wedge in said given direction, and a second suction device having a suction port formed therein at an end of said spinning wedge disposed upstream as seen in said given thread withdrawal direction, said first suction device including means for increasing the suction force along said spinning wedge from the rear toward the front.

7. Friction spinning device according to claim 6, including means for regulating said second suction device.

8. Friction spinning device according to claim 6, wherein said fiber feeding device includes means for transporting air and spinning fibers, said transporting means having a fiber channel ending in said spinning wedge, and including an air blast generator connected to said transporting means.

9. Friction spinning device according to claim 6, wherein said suction force increasing means are in the form of a widening of said suction port of said first suction device from said rear toward said front thereof.

10. Friction spinning device for producing a twisted thread from spinning fibers, comprising two friction elements moving in opposite directions and defining a spinning wedge therebetween having a front and a rear, at least one of said friction elements having a perforated wall, a first suction device disposed behind said perforated wall, said first suction device having a suction port formed therein directed against said spinning wedge, a fiber feeding device for feeding fibers to said spinning wedge in a given direction, a thread withdrawal device for withdrawing a thread from said spinning wedge in said given direction, and a second suction device having a suction port formed therein at an end of said spinning wedge disposed upstream as seen in said given thread withdrawal direction, said first suction device including means for increasing the amount of suction along said spinning wedge from the rear toward the front.

11. Friction spinning device according to claim 10, wherein said suction amount increasing means are in the form of a widening of said suction port of said first suction device from said rear toward said front thereof.

12. Friction spinning device for producing a twisted thread from spinning fibers, comprising two friction elements moving in opposite directions and defining a spinning wedge therebetween having a front and a rear, at least one of said friction elements having a perforated wall, a first suction device disposed behind said perforated wall, said first suction device having a suction port formed therein directed against said spinning wedge, a fiber feeding device for feeding fibers to said spinning wedge in a given direction, a thread withdrawal device for withdrawing a thread from said spinning wedge in said given direction, a second suction device having a suction port formed therein at an end of said spinning wedge disposed upstream as seen in said given thread withdrawal direction, and including means for strengthening friction forces acting on the thread being formed along said spinning wedge from the rear toward the front.

13. Friction spinning device according to claim 12, wherein said friction force strengthening means are in the form of an increase in the number of the perforations in at least one of said friction elements from the rear toward the front of said spinning wedge.

14. Friction spinning device according to claim 12, wherein said friction force strengthening means are in the form of an increase in the size of the perforations in at least one of said friction elements from the rear toward the front of said spinning wedge.

15. Friction spinning device according to claim 12, wherein said friction force stregthening means are in the form of an increase in the number and size of the perforations in at least one of said friction elements from the rear toward the front of said spinning wedge.

16. Friction spinning device according to claim 12, wherein said friction force stegthening means are in the form of a placement of perforations wherein one of said friction elements has perforations only at the front of said spinning wedge and the other of said friction elements has perforations throughout.

17. Friction spinning device according to claim 12, wherein said friction force stregthening means are in the form of an increase of the friction of the surface of at least one of said friction elements from the rear toward the front of said spinning wedge.

* * * * *